US009581064B2

(12) United States Patent
Janssen et al.

(10) Patent No.: US 9,581,064 B2
(45) Date of Patent: Feb. 28, 2017

(54) TRUCK PROVIDED WITH A DEVICE FOR LOWERING THE TEMPERATURE OF EXHAUST GAS

(71) Applicant: DAF Trucks N.V., Eindhoven (NL)

(72) Inventors: Franciscus Thomas Everardus Janssen, Beek en Donk (NL); Josef Saberi, Eindhoven (NL)

(73) Assignee: DAF Trucks N.V., Eindhoven (NL)

( * ) Notice: Subject to any disclaimer, the term of this patent is extended or adjusted under 35 U.S.C. 154(b) by 0 days.

(21) Appl. No.: 14/384,595

(22) PCT Filed: Mar. 11, 2013

(86) PCT No.: PCT/NL2013/050158

§ 371 (c)(1),
(2) Date: Sep. 11, 2014

(87) PCT Pub. No.: WO2013/137721

PCT Pub. Date: Sep. 19, 2013

(65) Prior Publication Data

US 2015/0040545 A1 Feb. 12, 2015

(30) Foreign Application Priority Data

Mar. 12, 2012 (NL) ..... 2008470

(51) Int. Cl.

| | |
|---|---|
| ***F01N 3/05*** | (2006.01) |
| ***F01N 13/08*** | (2010.01) |
| ***F01N 13/20*** | (2010.01) |

(52) U.S. Cl.

CPC ..... *F01N 3/05* (2013.01); *F01N 13/082* (2013.01); *F01N 13/20* (2013.01);
(Continued)

(58) Field of Classification Search

CPC ..... F02D 9/04; F01N 2240/20; F01N 1/166; F01N 13/02; F01N 13/10
(Continued)

(56) References Cited

U.S. PATENT DOCUMENTS 2,270,115 A * 1/1942 Eliot ..... F01N 1/10 181/263
3,669,216 A * 6/1972 Spies ..... F01N 1/08 181/240

(Continued)

FOREIGN PATENT DOCUMENTS

WO 2008/046006 A2 4/2008

OTHER PUBLICATIONS

International Search Report—PCT/NL2013/050158—Mailing Date: Jun. 5, 2013.

*Primary Examiner* — Patrick Maines
(74) *Attorney, Agent, or Firm* — Banner & Witcoff, Ltd.

(57) ABSTRACT

A device for use in a truck for lowering the temperature of exhaust gas of a combustion engine has a diffuser 1, which is provided with a cylindrical housing 3 provided with an inlet opening 5 in an end wall 7 and an elongated axially extending outlet opening 9 in the cylinder wall.

The device furthermore has a bent guide plate 25 which extends from the outlet opening 9, so that, as a result of the Coanda effect, the hot exhaust gas is diverted along the plate and the jet widens, so that a better mixing with the ambient air, and hence greater cooling, takes place.

13 Claims, 3 Drawing Sheets

(52) U.S. Cl.
CPC ..... *F01N 2270/02* (2013.01); *F01N 2470/02* (2013.01); *F01N 2590/08* (2013.01)

(58) Field of Classification Search
USPC ..... 60/324, 320
See application file for complete search history.

(56) References Cited

U.S. PATENT DOCUMENTS

| | | | | | |
|---|---|---|---|---|---|
| 3,952,823 | A * | 4/1976 | Hinderks | F01N 13/082 | 180/164 |
| 4,312,480 | A * | 1/1982 | Miller | B64D 33/04 | 239/127.3 |
| D350,722 | S * | 9/1994 | Figueroa | D12/345 | |
| 5,699,965 | A * | 12/1997 | Amelio | B64D 33/04 | 239/127.3 |
| 7,971,432 | B2 * | 7/2011 | Troxler | F01N 13/082 | 180/296 |
| 2007/0029132 | A1 * | 2/2007 | Feight | F01N 13/082 | 181/239 |
| 2008/0099276 | A1 * | 5/2008 | Bach | F01N 13/082 | 181/227 |
| 2009/0013675 | A1 | 1/2009 | Troxler | | |
| 2010/0242462 | A1 * | 9/2010 | Smith | F01N 13/082 | 60/324 |
| 2011/0214419 | A1 | 9/2011 | Castner et al. | | |

* cited by examiner

TRUCK PROVIDED WITH A DEVICE FOR LOWERING THE TEMPERATURE OF EXHAUST GAS

CROSS-REFERENCE TO RELATED APPLICATIONS

This application is a U.S. National Stage application under 35 U.S.C. §371 of International Application PCT/NL2013/050158 (published as WO 2013/137721 A1), filed Mar. 11, 2013, which claims priority to Application NL 2008470, filed Mar. 12, 2012. Benefit of the filing date of each of these prior applications is hereby claimed. Each of these prior applications is hereby incorporated by reference in its entirety.

Field Of The Invention

The invention relates to a truck provided with a combustion engine and an exhaust system for combustion gases, which exhaust system is provided with an exit, as well as a device for lowering the temperature of exhaust gas, connected to the exit.

The invention especially relates to a truck whose exhaust system is provided with a particulate filter which is to be periodically regenerated. This is done by burning the particles, whereby briefly the temperature of the exhaust gas is strongly increased. The exhaust gas is blown out on the side of the truck to prevent it causing damage to the truck. The temperature of the exhaust gas should be lowered as much as possible to prevent the exhaust gas causing damage to the environment (for example, roadside fire) or to persons present beside the truck, such as cyclists.

Prior Art

A device for lowering the temperature of exhaust gas is known from WO-A-2008/046006. This known device is formed by a tube which splits into a number of flat tubes, thereby providing better mixing of the hot exhaust gas with cool ambient air.

SUMMARY OF THE INVENTION

An object of the invention is to provide a truck provided with a device for lowering the temperature of exhaust gas, whereby the temperature of the exhaust gas is lowered more than with the known device. To this end, the truck according to the invention is characterized in that the exhaust system furthermore comprises a diffuser which is provided with a housing provided with an inlet opening which is connected to the exit, and an elongated outlet opening which is larger than the inlet opening and which substantially faces the side of the truck and a length side of which is present near or against a bent wall, such that the outflow direction of the exhaust gas is parallel to the bent wall. A diffuser is understood to be a mechanical device that lowers the speed of a gas stream and improves the mixing of the gas stream with ambient air. By directing the outflow direction of the exhaust gas along a bent wall, the gas stream, as a result of the Coanda effect, is partly deflected along the wall and the jet widens so that a better mixing with the ambient air takes place.

A favorable embodiment of the truck according to the invention is characterized in that the bent wall is part of a downwardly facing side of a damper of the exhaust system. This damper is, for example, a muffler.

Another favorable embodiment of the truck according to the invention is characterized in that the bent wall is formed by a bent guide plate which is part of the device and is attached to the housing of the diffuser.

To optimize the gas flow along the guide plate, the bent guide plate is preferably provided with ribs which extend at right angles to the outlet opening. Furthermore, preferably, the side edges of the guide plate are flanged over at right angles, such that they guide the gas stream.

Furthermore, the outlet opening preferably extends over the greater part of the length of the cylinder wall to further reduce the speed of the gas stream and improve mixing with ambient air.

A further favorable embodiment of the truck according to the invention is characterized in that the diffuser comprises an inlet tube which by one end links up with the inlet opening and extends in the housing, and is provided with a tube wall provided with holes. The exhaust gas flows via the inlet tube to the space in the housing that is present around the inlet tube and is thereby strongly slowed down.

Preferably, the housing of the diffuser is cylindrical and has a cylinder wall as well as two end walls, while the inlet opening is present in one of the end walls and the other end wall is closed, and the outlet opening is present in the cylinder wall and extends in axial direction of the housing. Here, preferably, the inlet tube extends parallel to the cylinder wall. Furthermore, preferably, in the housing at least one partition is present which is parallel to the end walls.

To further improve mixing of the exhaust gas with the ambient air, yet a further embodiment of the device according to the invention is characterized in that near the outlet opening in the cylinder wall at least one suction opening is present. Upon flow of the exhaust gas along the suction opening, ambient air is drawn in via this opening. This suction proceeds still better if the suction opening faces the outlet opening so that a reduced pressure is created adjacent the suction opening.

The invention also relates to a device for lowering the temperature of exhaust gas of a combustion engine of a truck, which device is suitable for use in a truck according to the invention. As regards the device, the invention is characterized in that the device comprises a diffuser, which is provided with a cylindrical housing provided with an inlet opening in an end wall and an elongated, axially extending outlet opening in the cylinder wall, which outlet opening is larger than the inlet opening, which diffuser comprises an inlet tube extending parallel to the cylinder wall in the housing, which inlet tube by one end links up with the inlet opening and is provided with a tube wall provided with holes.

A favorable embodiment of the device is characterized in that the device furthermore comprises a bent guide plate which is attached to the housing of the diffuser, such that a length side of the outlet opening is present near or against the bent guide plate and the outflow direction from the outlet opening is parallel to the bent guide plate.

For further embodiments of the device, reference is made to the appended claims.

BRIEF DESCRIPTION OF THE DRAWINGS

Below, the invention will be further elucidated on the basis of exemplary embodiments of the device according to the invention represented in the drawings. In the drawings.

DETAILED DESCRIPTION OF THE DRAWINGS

Figure 1:
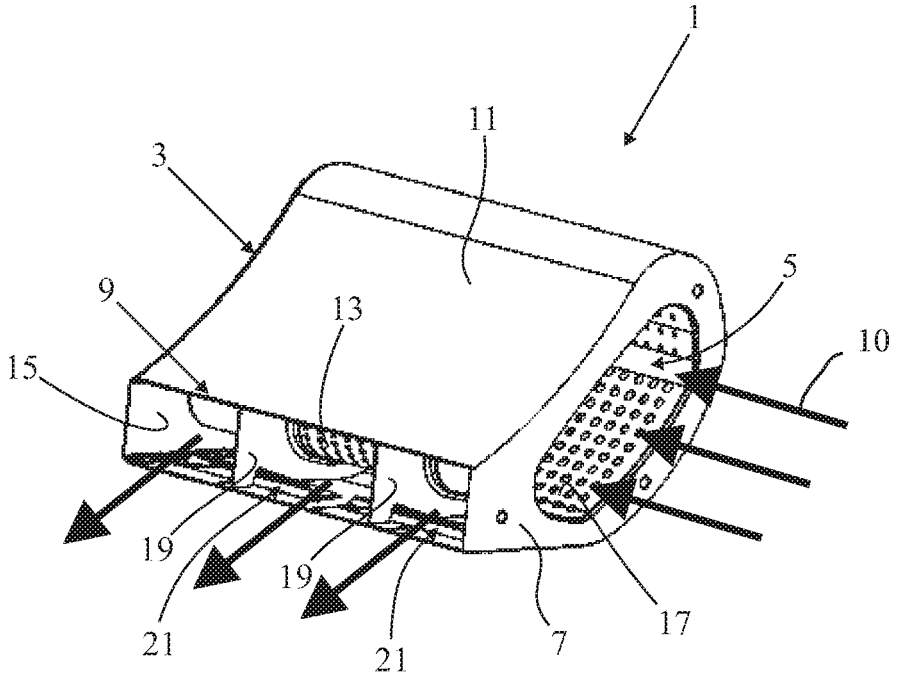
FIG. 1 shows a first embodiment of the device according to the invention configured as a diffuser.

In FIG. 1 a first embodiment of the device according to the invention is represented. The device is here configured as a diffuser 1 which is provided with a cylindrical housing 3 provided with an inlet opening 5 in an end wall 7 and an elongated outlet opening 9 in the cylinder wall 11, extending in an axial direction 10 throughout the length of the cylinder wall. The outflow section of the outlet opening 9 is here larger than the inflow opening of the inlet opening 5.

Figure 2:
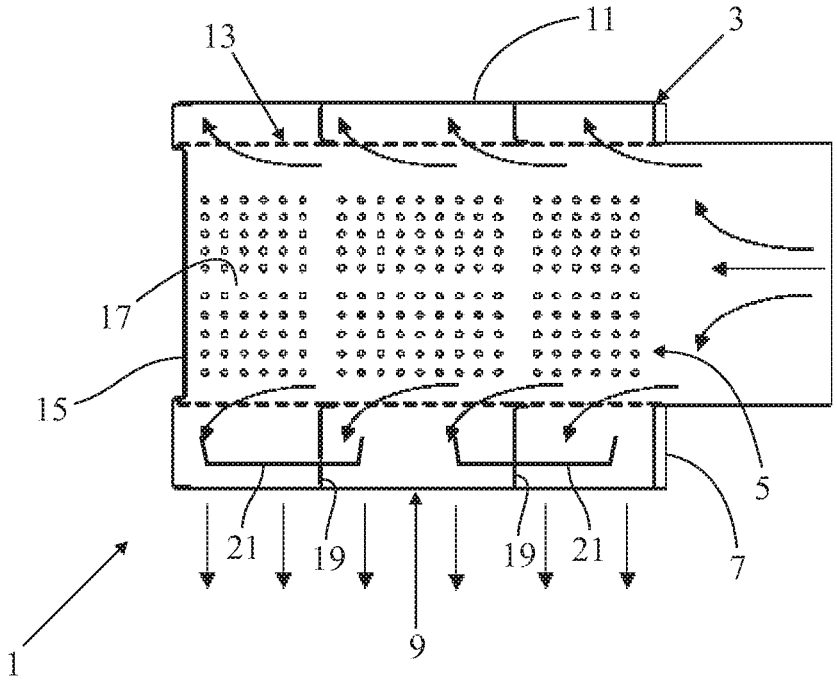
FIG. 2 shows a longitudinal cross-section of the diffuser represented in FIG. 1, in which the flow of the exhaust gas is indicated.
Figure 3:
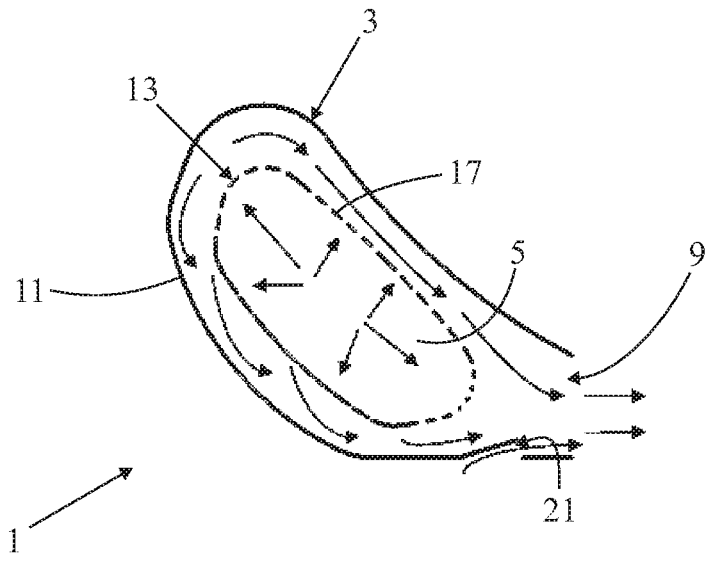
FIG. 3 shows a transverse cross-section of the diffuser represented in FIG. 1, with indication of the flow of the exhaust gas.

The diffuser furthermore has an inlet tube 13 which extends parallel to the cylinder wall 11 in the housing 3 and which by one end links up with the inlet opening 5 and whose other end is closed by the other end wall 15 of the housing 3. The tube wall 17 of the inlet tube is perforated, whereby during operation the exhaust gas flows through the holes to the space in the housing around the inlet tube and out via the outlet opening, as is indicated with arrows in FIGS. 2 and 3.

In the housing 3 there are two partitions 19 which are parallel to the end walls 7 and 15 to provide better distribution of the outflow of the exhaust gas over the length of the outlet opening 9. These partitions are provided with openings through which extends the inlet tube 13.

Near the outlet opening 9, suction openings 21 are present in the cylinder wall 11, via which ambient air is drawn in to cool the exhaust gas. These suction openings 21 face the outlet opening 9. This is especially clearly visible in FIG. 3.

Figure 4:
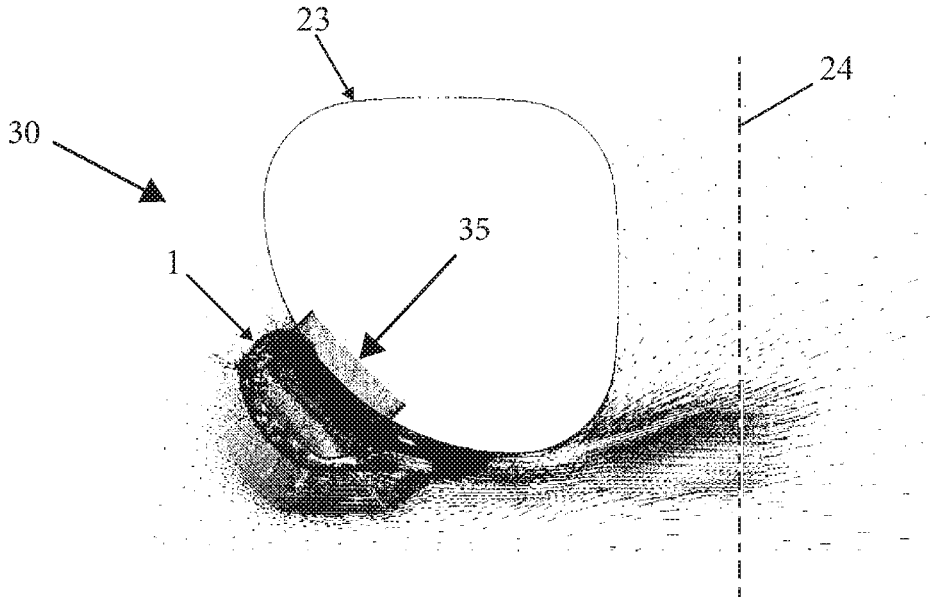
FIG. 4 shows the diffuser represented in FIG. 1 present on a muffler of a truck.

To illustrate the effect of the device according to the invention, in FIG. 4 the diffuser 1 is shown present on a muffler 23, as components of an exhaust gas system 30 of a truck during operation. Exit 35 of muffler 23 is connected to the inlet of diffuser 1. Indicated in black is the temperature of the exhaust gas and the ambient air. At the solid black parts the temperature is highest, and the temperature is lower as the density of black decreases. Centerline 24 denotes the side of the truck. It can be clearly seen in this figure that outside the truck (i.e., to the right of the centerline 24) only few black areas are visible anymore and that these areas are far from solid black, which is indicative of only a low temperature of the exhaust gas.

Figure 5:
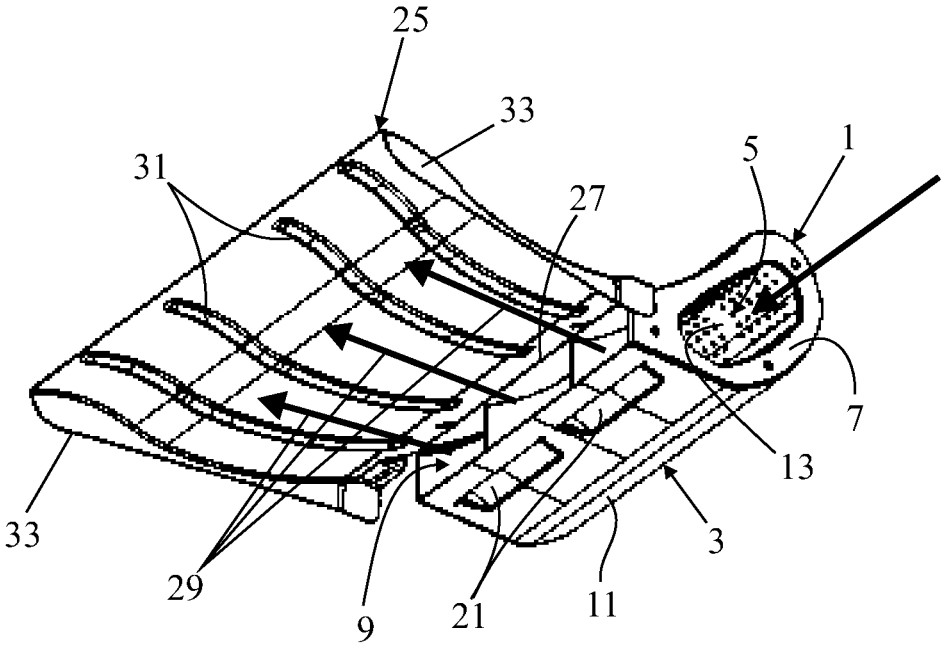
FIG. 5 shows a second embodiment of the device according to the invention provided with a guide plate.
Figure 6:
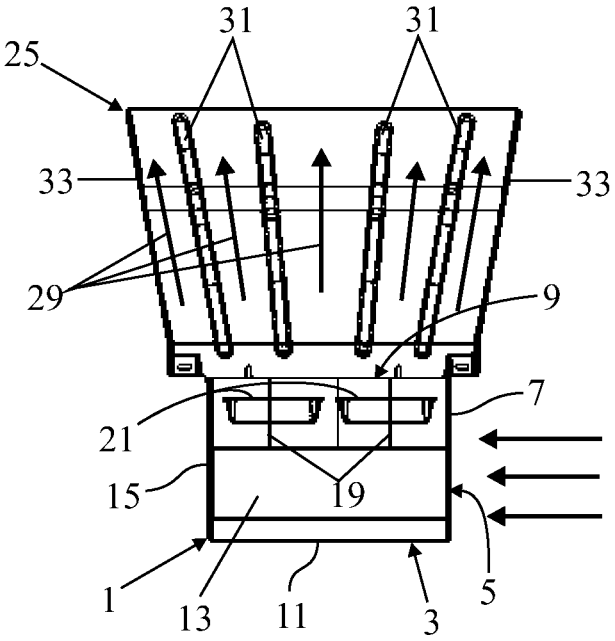
FIG. 6 shows a longitudinal cross-section of the diffuser with guide plate represented in FIG. 5, in which the flow of the exhaust gas is indicated.

In FIG. 5 a second embodiment of the device according to the invention is represented. This device has the same diffuser as the first embodiment and has a bent guide plate 25 as an extra, so that it can also be used if there is no bent wall on hand. The guide plate 25 is connected with the housing 3 of the diffuser 1, such that a length side 27 of the outlet opening 9 is present near or against the bent guide plate and the outflow direction 29 from the outlet opening is parallel to the bent guide plate.

To guide the gas stream better, the guide plate 25 is provided with ribs 31 which extend at right angles to the outlet opening 9. The side edges 33 of the guide plate are flanged over at right angles to prevent the gas stream flowing away to the sides too much so that the favorable Coanda effect would be utilized less.

While in the foregoing the invention has been elucidated with reference to the drawings, it will be appreciated that the invention in no way is limited to the embodiments shown in the drawings. The invention also encompasses all embodiments deviating from the embodiments shown in the drawings within the scope defined by the claims.

The invention claimed is:

1. An exhaust system comprising a muffler and a diffuser for lowering the temperature of exhaust gas of a combustion engine, wherein the diffuser comprises a housing having a cylinder wall and first and second end walls, an inlet opening in one of the first and second end walls, and an elongated outlet opening in the cylinder wall, extending in an axial direction of the housing, the outlet opening being larger than the inlet opening, wherein the diffuser further comprises an inlet tube extending parallel to the cylinder wall within the housing, wherein the inlet tube has one end connected to the inlet opening and comprises a tube wall perforated with holes, and wherein a length side of the elongated outlet opening is adjacent a bent wall and is configured to provide an outflow direction of the exhaust gas parallel to the bent wall, wherein the bent wall is one of (i) a part of a downwardly facing side of the muffler and and (ii) formed by a bent guide plate attached to the housing of the diffuser on a side of the housing opposite which suction openings are present to allow ambient air to flow into the housing for mixing with the exhaust gas near the outlet opening.

2. A truck comprising a combustion engine and the exhaust system of claim 1 for combustion gases, wherein the elongated outlet opening faces a side of the truck and is configured to discharge the exhaust gas on the side of the truck in a direction orthogonal to a direction of motion of the truck.

3. The truck according to claim 2, wherein the bent guide plate comprises ribs which extend at right angles to the outlet opening.

4. The truck according to claim 3, wherein side edges of the bent guide plate are flanged over at right angles, such that they guide the exhaust gas.

5. The truck according to claim 2, wherein the other of the first and second end walls is closed.

6. The truck according to claim 5, wherein the outlet opening extends over a greater part of the length of the cylinder wall.

7. The truck according to claim 2, wherein at least one partition is positioned in the housing and is parallel to the first and second end walls, and wherein the at least one partition includes an opening through which the inlet tube extends.

8. The exhaust gas system of claim 1, wherein the side of the housing of the diffuser to which the bent guide plate is attached is the length side of the outlet opening, whereby the bent guide plate is configured to provide an outflow direction from the outlet opening parallel to the bent guide plate and create a Coanda effect, and wherein the suction openings are adjacent a second length side of the outlet opening, opposite the length side of the outlet opening to which the bent guide plate is attached.

9. The exhaust gas system of claim 8, wherein the bent guide plate comprises ribs, including both centrally disposed ribs and peripherally disposed ribs, which extend at right angles to the outlet opening.

10. The exhaust gas system of claim 9, wherein side edges of the bent guide plate are flanged over at right angles, such that they guide the exhaust gas.

11. The exhaust gas system of claim 1, wherein the outlet opening extends over a greater part of the length of the cylinder wall.

12. The exhaust gas system of claim 1, wherein at least one partition is positioned in the housing and is parallel to the first and second end walls, and wherein the at least one partition includes an opening through which the inlet tube extends.

13. The exhaust gas system of claim 12, wherein the suction openings are configured for mixing the ambient air with different portions of the exhaust gas that are separated by the at least one partition.

* * * * *